United States Patent [19]

Shimada et al.

[11] Patent Number: 5,036,827

[45] Date of Patent: Aug. 6, 1991

[54] IGNITION COIL-INCORPORATED DISTRIBUTOR FOR INTERNAL COMBUSTION ENGINES

[75] Inventors: Junichi Shimada, Hitachi; Kazutoshi Kobayashi, Katsuta; Noboru Sugiura, Mito; Kazuhiko Kawakami; Ryoichi Koshida, both of Katsuta, all of Japan

[73] Assignee: Hitachi, Ltd., Tokyo, Japan

[21] Appl. No.: 516,312

[22] Filed: Apr. 30, 1990

Related U.S. Application Data

[62] Division of Ser. No. 341,762, Apr. 21, 1989, Pat. No. 4,979,486.

[30] Foreign Application Priority Data

Apr. 26, 1988 [JP] Japan ..... 63-101227
Aug. 1, 1988 [JP] Japan ..... 63-190644

[51] Int. Cl.[5] ..... F02P 7/00

[52] U.S. Cl. ..... 123/634; 123/635

[58] Field of Search ..... 123/635, 634, 146.5 A, 123/647

[56] References Cited

U.S. PATENT DOCUMENTS

| | | | |
|---|---|---|---|
| 1,277,388 | 9/1918 | Conrad | 123/647 |
| 1,458,548 | 6/1923 | Rosner | 123/146.5 A |
| 2,057,240 | 10/1936 | Mallory | 123/635 |
| 2,224,744 | 12/1940 | Piffath | 123/635 |

*Primary Examiner*—Andrew M. Dolinar
*Attorney, Agent, or Firm*—Antonelli, Terry, Stout & Kraus

[57] ABSTRACT

An ignition coil in which an ignition coil is incorporated in a distributor housing is characterized in that the ignition coil has an annular core, and is disposed in the distributor housing so that the annular core surrounds a distributor-shaft support portion of the housing.

6 Claims, 5 Drawing Sheets

IGNITION COIL-INCORPORATED DISTRIBUTOR FOR INTERNAL COMBUSTION ENGINES

This is a division of application Ser. No. 341,762, filed Apr. 21, 1989, now U.S. Pat. No. 4,979,486.

BACKGROUND OF THE INVENTION

This invention relates to an ignition coil for internal combustion engines, and more particularly, to an ignition coil for internal combustion engines incorporated in a distributor.

In, for example Japanese Patent Publication No. 60-18834/1985, an ignition coil-incorporated distributor comprises a housing, a rotor shaft rotatably supported by the housing, a cap fitted to the housing, a distributor part including a rotor electrode mounted on a rotor top end of the rotor shaft and a side electrode mounted on the cap to face the rotor electrode with a gap therebetween. An ignition coil is secured to the housing, with a signal rotor being secured to the rotor shaft, and with a magnetic pickup for picking up signals and interrupting current flowing in a primary coil of the ignition coil according to the signal to cause a secondary coil of the ignition coil to induce a high voltage.

In the above noted ignition coil-incorporated distributor, the ignition coil is mounted on the housing at a position separated from the rotor shaft on one side by a sufficient distance through a screw means passing through a hole formed in a core of the ignition coil in a direction perpendicular to the axis of the rotor shaft.

Disadvantages of the above noted distributor resides in the fact that a portion of the distributor in which the ignition coil is provided projects sideways to thereby increasing the dimensions of the distributor. Moreover, the weight of the ignition coil having a winding wound around an iron core thereof and provided at a side portion of the housing represents a considerable percentage of a total weight of the distributor, so that the distributor becomes unstable with respect to the longitudinal axis thereof, and may create problems when mounted on a vehicle.

Furthermore, the ignition coil is fixed by screw means at right angles to the direction of the longitudinal axis of the distributor. Consequently, parts of the distributor are threadably secured in various directions thereby requiring a complicated distributor assembling operation, and corresponding decrease in the assembling efficiency.

In, for example Japanese Patent Laid-Open No. 61-231708/1986, an ignition coil comprises an iron core including an axially elongated cylindrical core axially elongated, a pair of cruciform cores disposed on upper and lower sides of the cylindrical core, respectively, and four radially extending arm portions and plate-like cores at the tips of the arm portions to magnetically connect the upper and lower cruciform cores. Windings are wound around the cylindrical core through which a rotor shaft of the distributor passes, with the ignition coil being mounted on the upper side of a bearing for supporting the rotor shaft.

Disadvantages of the last mentioned distributor resides in the fact that the iron core is very complicated and, since the ignition coil is disposed at the upper side of the bearing for the rotor shaft, the size of the distributor increases in the direction of the longitudinal axis thereof by the height of the ignition coil. When the shaft is connected directly to a cam shaft in an engine, the distance between the bearings for the shaft decreases, so that the shaft shakes during the rotation thereof. This would cause interference of parts secured to the shaft with other parts facing the parts and generation of an unstable output signal.

When the last mentioned distributor is disposed laterally in an engine, that is, with the longitudinal axis of the distributor is disposed horizontal, the center of gravity thereof in the direction of the longitudinal axis thereof separates from the position in which the distributor is fixed to the engine resulting in the distributor being readily vibrated thereby lowering the reliability of the strength thereof.

SUMMARY OF THE INVENTION

An object of the present invention is to provide an ignition coil-incorporated distributor for internal combustion engines, which is simple in construction, small-sized, mechanically stable and capable of being easily assembled.

In accordance with advantageous features of the present invention, an ignition coil-incorporated distributor for internal combustion engines generates crank angle position signals according to rotation of an engine, generates a high voltage according to ignition timing signals generated based on the crank angle position signal, etc. and distributes the high voltage to each cylinder of the engine. The distributor includes a housing, a rotor shaft provided in the housing so as to rotate synchronously with the rotation of the engine and an ignition coil set firmly in the housing and supplying a high voltage to an ignition plug in each cylinder of the engine in accordance with the ignition timing signal, with a core of the ignition coil being annularly formed, and incorporated in the housing so as to surround the rotor shaft.

Preferably, according to the present invention the ignition coil is incorporated in the housing so that the core of the ignition coil surround the outer side of a hollow shaft support portion upstanding from a bottom portion of the housing.

According to further features of the present invention, the rotor shaft of the distributor is inserted through the annularly formed core of an ignition coil whereby the distributor as a whole is reduced in size and the center of gravity of the distributor in the radial direction can be set at a position very close to the longitudinal axis thereof. Moreover, the center of gravity of the distributor on its longitudinal axis can be set at a position in the vicinity of the position in which the distributor is fixed to the engine.

The ignition coil is incorporated into the housing by fixing the core thereof to the housing by screw means in the direction in which the rotor shaft of the distributor extends, in the same manner as other parts.

Therefore, according to the present invention, the dimensions of the distributor as a whole decrease, and the distance between bearings for supporting the shaft can be long, whereby the shaking of the shaft during the rotation thereof does not occur. The ignition coil is incorporated into the housing by a simple assembling operation with the stability and strength of the distributor kept sufficiently high.

In accordance with still further features of the present invention, an ignition coil-incorporated distributor for internal combustion engines is provided which comprises a housing, a shaft supported by the housing and an ignition coil incorporated into the housing, with an enclosure member being provided to secure the ignition coil to the housing, and with a core of the ignition coil being secured to the housing by fastening the enclosure member to the housing with screw means.

By virtue of the last mentioned features of the present invention, it is unnecessary to provide holes in the core and, without the holes, the core is not provided with a hollow which prevents the passage of magnetic flux. Moreover, the core can be made compact and provide a higher performance level. With the core being made more compact, it is then possible for the ignition coil or distributor itself to be more compact.

It is then possible for the ignition coil or distributor itself to be more compact.

Moreover, by fixing the enclosure member to the housing with screw means, the setting positions for the screw means as well as the fastening directions can be freely selected with ease thereby providing a degree of freedom in designing the distributor so as to be suitable for an automation process. Additionally, it is also possible to provide for a housing having a construction which is relatively uncomplicated.

DETAILED DESCRIPTION OF THE INVENTION

Figure 1:
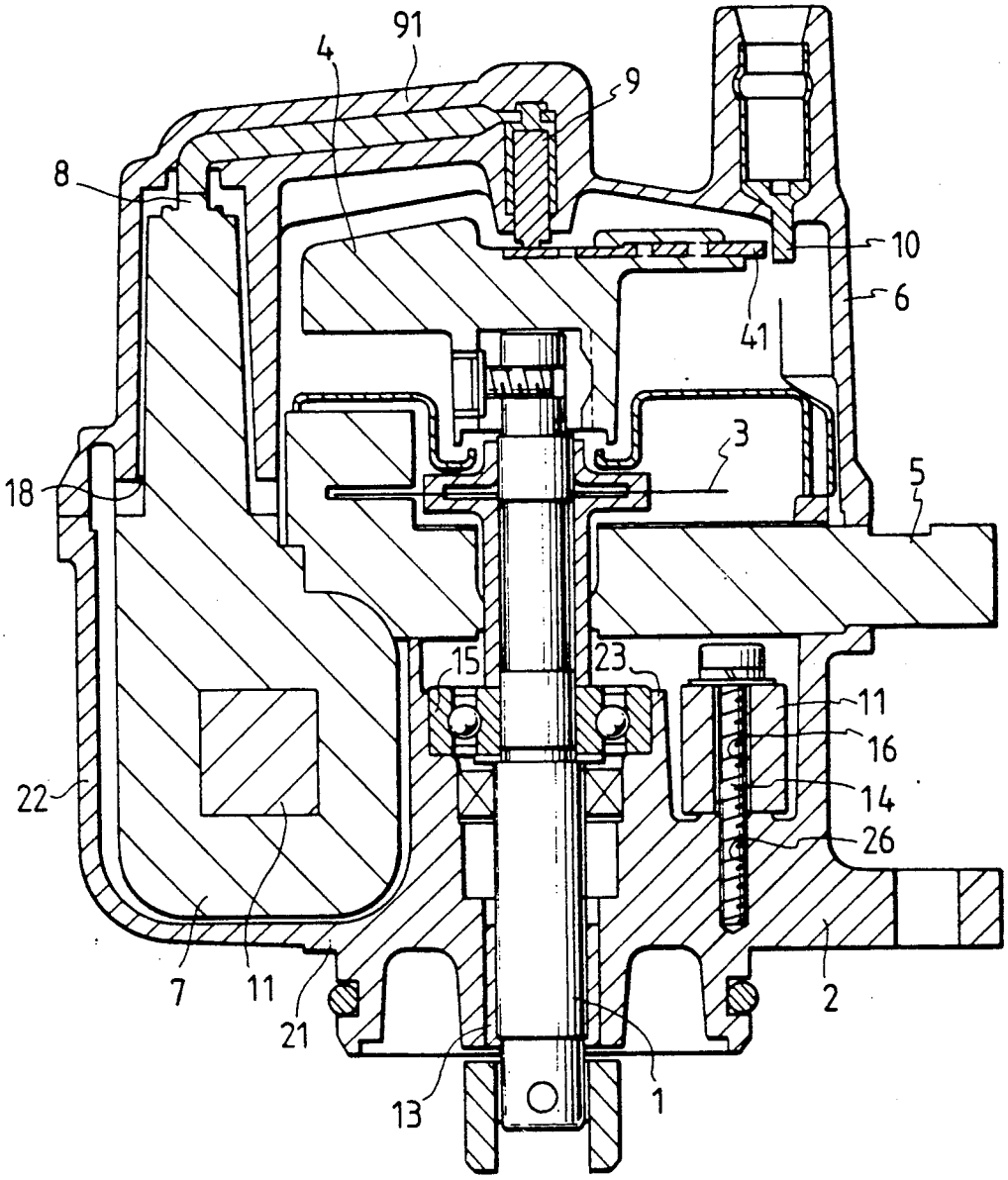
FIG. 1 is a longitudinally sectional view showing the construction of an embodiment of an ignition coil-incorporated distributor according to the present invention.
Figure 2:
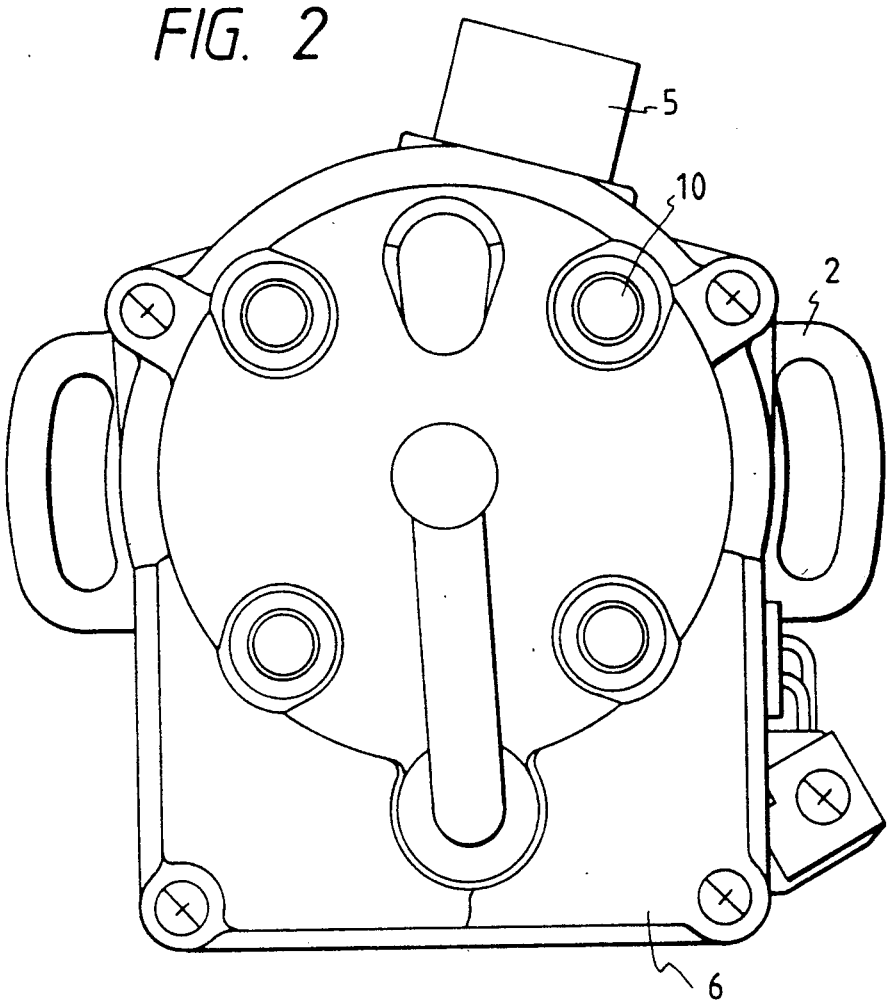
FIG. 2 is a plan view showing the construction of the ignition coil-incorporated distributor in the embodiment.
Figure 3:
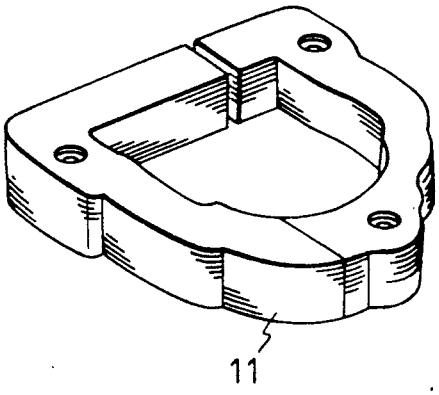
FIG. 3 is a perspective view showing the construction of an iron core of an ignition coil of the ignition coil-incorporated distributor in the embodiment.

The ignition coil-incorporated distributor has function of generating a crank angle position signal according to rotation of an internal combustion engine, generating a high voltage according to ignition timing signals generated, for example, in a control unit (not shown) based on the crank angle position signal and distributing it to an ignition plug of each cylinder of the engine. The distributor, as shown in FIG. 1, comprises a housing 2, an ignition coil 7 incorporated in the housing 2, a rotor shaft 1 rotatably supported by the housing 2, and a signal rotor 3 secured to the shaft 1. The signal rotor 3 has a plurality of radially extending projections with the number of projections corresponding to the number of cylinders of the engine (not shown). A signal pickup device 5 picks up a signal in cooperation with the signal rotor 3 as a crank angle position signal which is inputted into a control unit (not shown) to generate an ignition timing signal employing the crank angle position signal, etc. Electric current flowing in a primary coil or winding of the ignition coil 7 is interrupted according to the ignition timing signal to induce a high voltage in a secondary coil or winding of the ignition coil 7, that is, at an output terminal of the ignition coil 7. A rotor head 4 is mounted on the top of the shaft 1, and a cap 6 is fitted to the housing 2 so as to enclose the pickup device 5 and ignition coil 7. A central electrode 9 is positioned at the central portion of the rotor head 4 and a side electrode 10 is fixed thereto and positioned at one side of the rotor head 4 with a gap therebetween.

Figure 7:
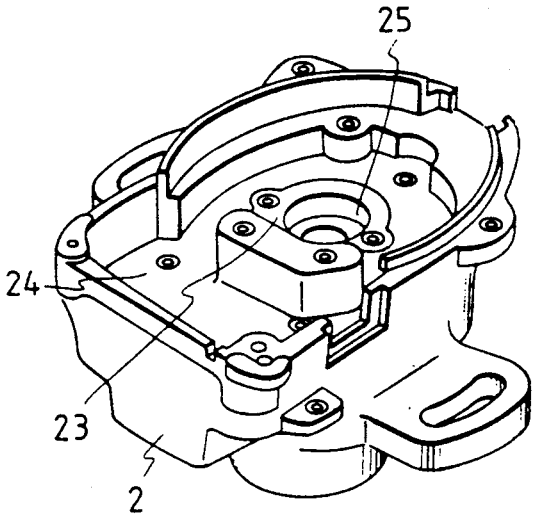
FIG. 7 is a perspective view showing the construction of a housing of the ignition coil-incorporated distributor in the embodiment.
Figure 6:
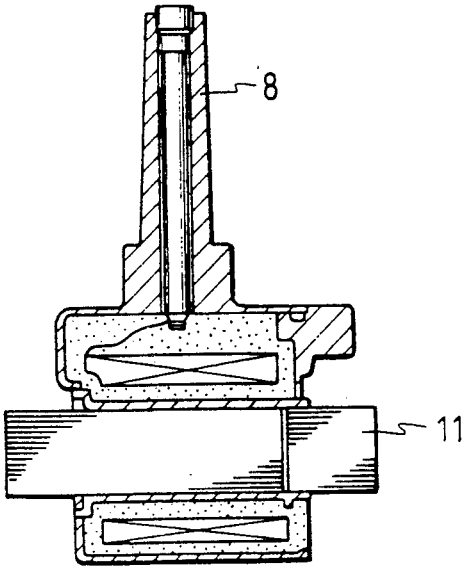
FIG. 6 is a sectional view of the ignition coil taken along a line VI—VI of FIG. 5.

The housing 2, as shown in FIGS. 1 and 7, includes a bottom portion 21, a side wall portion 22 upstanding from the periphery of the bottom portion 21, and a shaft support portion 23 projecting from the bottom portion 21 into the interior of the housing 2, whereby an annular recess 24 is defined for accommodating the ignition coil 7. The shaft support portion 23 has a through hole 25 formed therein in which, as shown in FIG. 1, a ball bearing 15 and a journal bearing 13 are fitted with an axial distance therebetween. The rotor shaft 1 is rotatably supported by the housing 2 through the bearings 15, 13.

Figure 4:
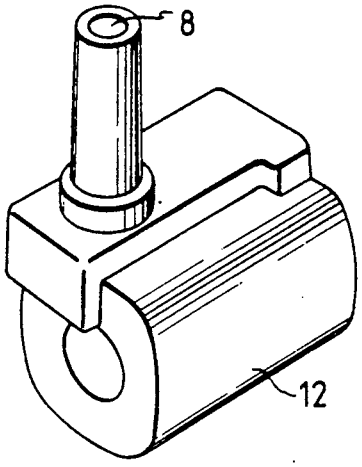
FIG. 4 is a perspective view showing the construction of winding in the ignition coil of the ignition coil-incorporated distributor in the embodiment.
Figure 5:
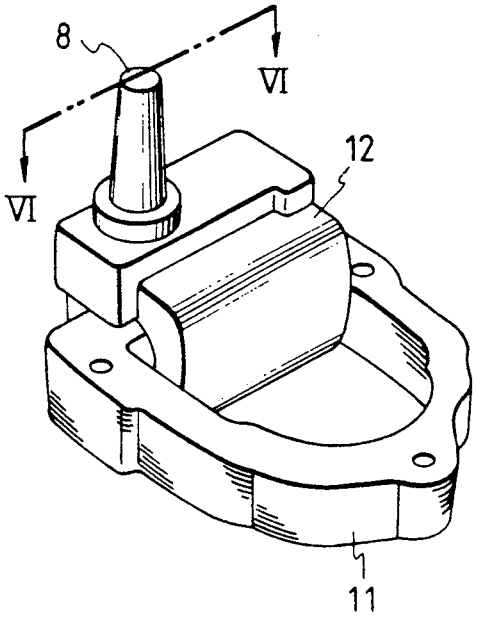
FIG. 5 is a perspective view showing the construction of the ignition coil in the embodiment.

The ignition coil 7, as shown in FIGS. 3 to 6, comprises an iron core 11 made of a plurality of core plates, and shaped annularly, a winding 12 including primary and secondary windings wound around a part of the iron core 11, and a core electrode 8. The iron core 11 is inserted into the winding 12 as shown in FIG. 4 by inserting repeatedly each several plates of the iron core 11 into the winding 12.

The ignition coil 7 is set in the recess 24 in the housing 2 in such a manner that the shaft support portion 23 is inserted in or surrounded by the annular core 11 of the ignition coil 7. The ignition coil 7 has fixing bores 16 formed in the iron core 11 thereof so as to extend in the direction which the shaft 1 extends, and the iron core 11 is unitarily fixed to the housing 2 by set screws 14 passing through the bores 16 and engaged with threaded bores 26 formed in the housing 2. The shaft 1 passes through and is surrounded by the iron core 11 of the ignition coil 7.

As is shown in FIG. 1, the upper surface of the core 11 of the ignition coil 7 is in substantially the same level of the upper end of the shaft support portion 23 of the housing 2, so that the axial length of the distributor is reduced and the distance between the bearings 15 and 13 can be extended.

The ignition coil 7 has the coil electrode 8 upstanding from the windings. The coil electrode 8 is inserted in a hole formed in the cap 6 at one side thereof, and electrically connected with an electrode member 91 embedded in the housing 2 and connected to the central electrode 9. A space 18 is formed between the coil electrode 8 and an inside wall of the hole for accommodating the coil electrode 8, and is fashioned as a labyrinth whereby the length of the labyrinth from the winding portion to a contact portion with the electrode member 91 is sufficient to preclude influencing the atmosphere outside the distributor.

When the shaft 1 is synchronously rotated with the rotation of the engine (not shown), the rotation of the signal rotor 3 is detected as a crank angle position signal of the engine, by the signal pickup device 5 or signal detector, and this crank angle position signal is inputted into the control unit (not shown). This control unit outputs an ignition timing signal for the engine into the distributor, and this ignition timing signal causes a high voltage to be induced at the output terminal of the ignition coil.

The high voltage thus induced in the ignition coil 7 is applied from the coil electrode 8 to an electrode 41 of the rotor head 4 through the electrode member 91 and the central electrode 9 on the cap 6 and discharged from the rotor head 4 to the side electrodes 10 on the cap 6. Owing to this discharge, the high voltage is applied to the ignition plug in each cylinder of the engine (not shown).

According to this embodiment, the distributor as a whole can be formed to smaller dimensions or compact since the shaft support portion 23 of the housing 2 is positioned on the inner side of the annular iron core 11 of the ignition coil 7. The center of gravity of the distributor is set in the substantially central portion of the shaft 1 in the radial direction, and in a position in the vicinity of the position in which the distributor is set in the engine, in the direction in which the shaft 1 extends. Accordingly, the distributor can be set in the engine stable and operated without being vibrated, and the strength of the distributor is improved.

Moreover, the distance between the bearings 15 and 13 for the shaft 1 can be long, and this enables the shaking of the shaft 1, rotor head 4 and signal rotor 3 to be minimized, and stable crank angle position signal and discharge output signal to be supplied.

Since the ignition coil 7 is fixed at its iron core 11 to the housing by the set screws 14 in the direction in which the shaft 1 extends, the assembling efficiency is very high, and the manufacturing cost can be reduced.

The distributor is of the type wherein the distributor is directly connected to an engine cam.

Figure 8:
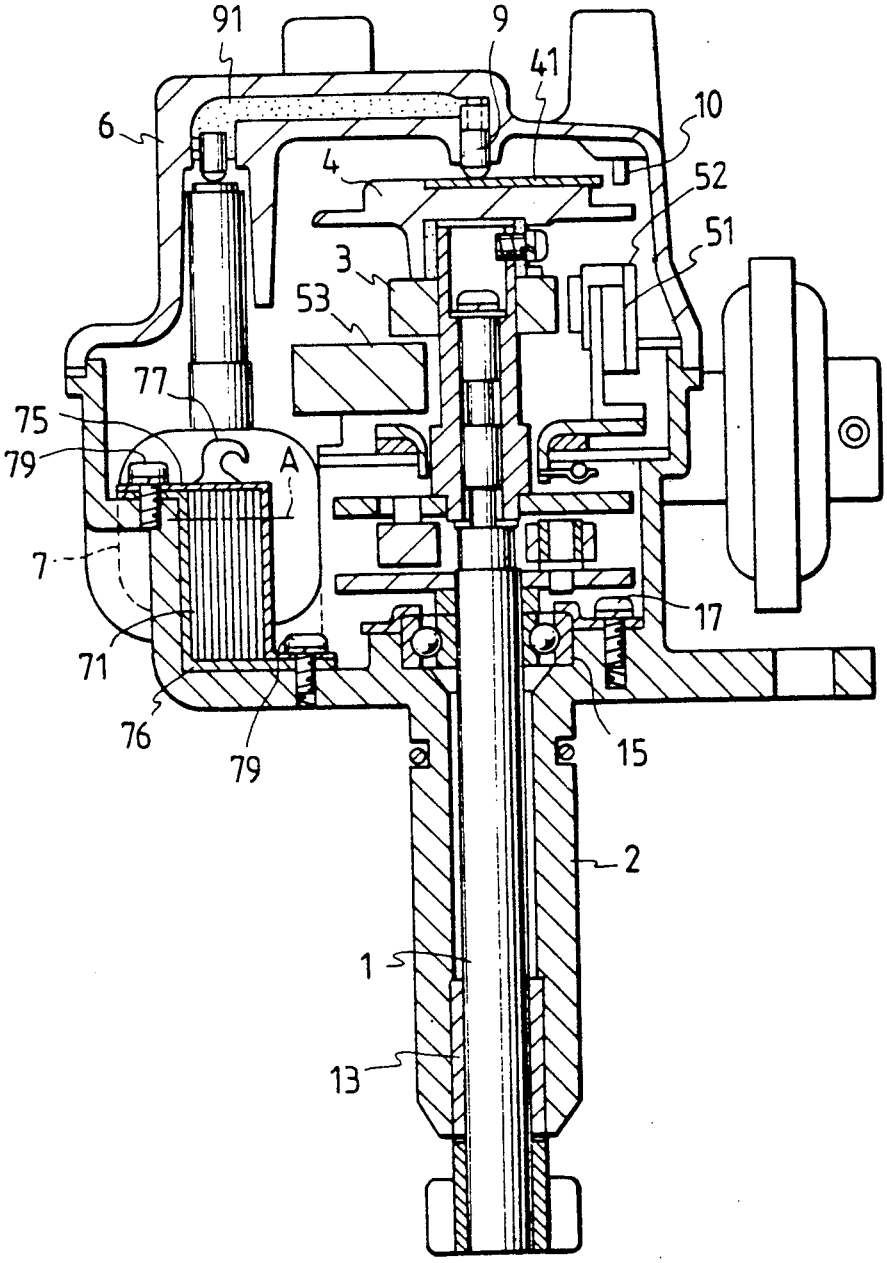
FIG. 8 is a longitudinally sectional view of another embodiment of an ignition coil-incorporated distributor according to the present invention.

In the embodiment of FIG. 8, a shaft 1 is inserted at its one end portion into a housing 2 and rotatably supported on a ball bearing 15, with the shaft 1 being synchronously rotated with a crankshaft (not shown) of a gasoline engine at a speed half as high as that of this crankshaft.

A signal rotor 3 is secured to the shaft 1 and has a plurality of radially extending projections the number of which is equal to the number of engine cylinders.

An electromagnetic pickup device 5 comprising a coil 52 and a field magnet 51 is provided in opposition to and in a spaced state from the signal rotor 3, and fixed to the housing 2.

A voltage induced in the electromagnetic pickup coil 52 in accordance with the rotation of the signal rotor 3 is used to control the interruption of current flowing in a primary winding of the ignition coil 7 through an ignition amplifier 53.

When the current flowing in the primary winding is discontinued, a high voltage is induced in a secondary winding of the ignition coil 7 and is distributed to ignition plugs (not shown) through an electrode 41 of a rotor head 4 and an electrode 10 provided on a cap 6.

A core 71 of the ignition coil 7 is held between a pair of core holders 75, 76, which constitute an enclosure member of the core 71.

These two core holders 75, 76 are provided with through bores for set screws. Set screws 79 are inserted into the through bores so as to fasten the core holders 75, 76 to the housing 2.

When a hook 77 is provided on the core holder 75, the ignition coil 7 can be hooked up conveniently when it is taken out. Also, when the ignition coil 7 is installed in the housing 2, it can be gripped at the hook 77 and placed properly.

A box type core holder (not shown) may be formed in place of the core holders 75, 76 so that the core 71 can be inserted into and withdrawn from the box type core holder, with the core 71 of the ignition coil held between the core holder and housing 2. When the core holder is formed in this manner, a one piece core holder can be obtained.

If set screw holes are provided in a direction of the line A in the core 71, and, if the core 71 is fastened to the housing 2 with set screws (not shown), a hollow is formed in the core 71, so that the magnetic flux passage is blocked. Moreover, the efficiency of operations for inserting and tightening set screws in this direction becomes very low. Additionally, it is difficult to provide holes for accommodating the set screws which extend in a direction of the line A in the housing 2.

On the other hand, the set screws 79 in the embodiment of FIG. 8 extend in parallel with the shaft 1. Accordingly, the forming of screw holes and the inserting and tightening of the set screws can be easily accomplished, and this distributor is suitable to be produced automatically. The reason why the positions in which the set screws are arranged and the direction in which these screws are extended can be determined favorably resides in that the core 71 is set via the core holder 75, 76.

Figure 9:
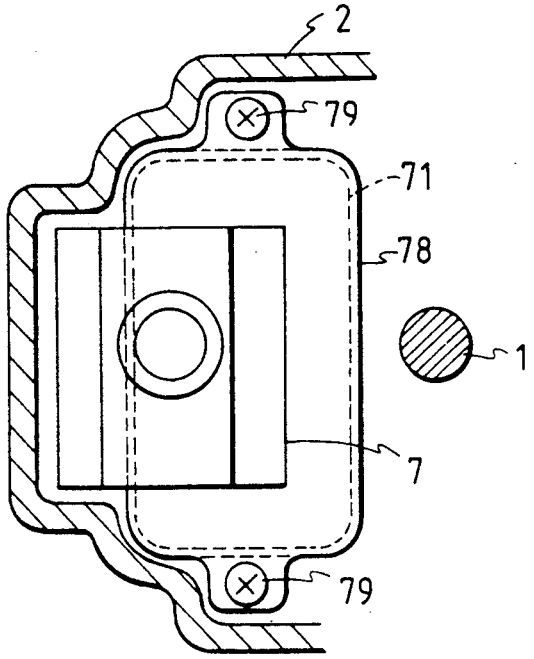
FIG. 9 is a partial horizontally sectional view of another embodiment of an ignition coil-incorporated distributor according to the present invention.

In FIG. 9, a holder 78 is welded to a core 71 of an ignition coil 7. Even in such a structure, the same effect as in the embodiment of FIG. 8 can be obtained.

Figure 10:
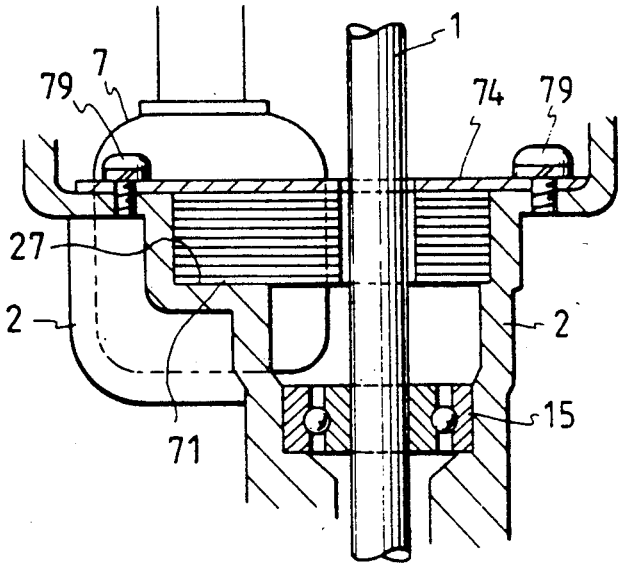
FIG. 10 is a longitudinally sectional view of another embodiment of an ignition coil-incorporated distributor according to the present invention.

In FIG. 10, a core 7 of an ignition coil 71 and a core holder 74 are provided with through holes at which the core 71 and core holder 74 are fitted loosely around a shaft 1. The through holes allow the shaft 1 to be passed therethrough. According to the embodiment of FIG. 10, the core 72 can be held in a miniaturized housing by effectively utilizing a space around the shaft 1 in the housing 2. The core 72 is fitted in a recessed seat 27 provided in the housing 2, and it is fixed by being pressed by the core holder 74 consisting of a holding metal type flat plate. According to the embodiment of FIG. 10, the core holder 74 can be formed in a simple shape, and the manufacturing cost is low.

According to the present invention, the distributor can be made compact and set in the engine so that the distributor can be operated stably. This distributor has a high assembling efficiency, and is suitable to be produced automatically. Moreover, the construction of the constituent parts is simple.

What is claimed is:

1. An ignition coil-incorporated distributor comprising a housing adapted to be fixed to an internal combustion engine, a shaft having one end portion thereof inserted into said housing to be synchronously rotated with a crankshaft of said internal combustion engine, a signal rotor mounted on said shaft, a rotation signal detector provided in said housing spaced from and disposed in opposition to said signal rotor for generating a signal synchronous with a rotation of said signal rotor, an ignition coil provided in said housing and including a core disposed on a bottom portion of said housing and a primary and secondary winding wound around a magnetic path forming core, an enclosure means made of metal material for retaining said core, said enclosure means having a first portion covering an entire surface of at least one side of said core disposed opposite to the bottom portion of said housing and a second portion extending beyond said entire surface of said core, at least one through hole provided in said second portion extending in parallel to said shaft, and a set screw passing through said through hole of said enclosure means for fastening said enclosure means to an inner surface of said housing so as to fix said ignition coil to the inner surface of said housing.

2. An ignition coil-incorporated distributor according to claim 1, wherein said enclosure means is detachably mounted on said core, said enclosure means being fastened to said housing so as to cause said core to be held firmly between said housing and said enclosure means.

3. An ignition coil-incorporated distributor according to claim 1, wherein said enclosure means is constructed as a flat substantially planar metal plate, and wherein said through hole is disposed in a peripheral portion of said metal plate.

4. An ignition coil-incorporated distributor according to claim 3, wherein said bottom portion of said housing includes a recessed seat formed therein, said core being disposed on said recessed seat and fixed by said metal plate.

5. An ignition coil-incorporated distributor according to claim 4, wherein said coil and said metal plate each include a through hole through which said shaft passes.

6. An ignition coil-incorporated distributor comprising a housing adapted to be fixed to an internal combustion engine, a shaft having one end portion thereof inserted into said housing to be synchronously rotated with a crankshaft of said internal combustion engine, a signal rotor mounted on said shaft, a rotation signal detector provided in said housing spaced from and disposed in opposition to said signal rotor for generating a signal synchronous with a rotation of said signal rotor, an ignition coil provided in said housing and including a core and a primary and secondary winding wound around a magnetic path forming core, an enclosure means for retaining said core, and fastening means for fastening said enclosure means to an inner surface of said housing so as to fix said ignition coil to said inner surface of said housing, said enclosure means being detachably mounted on said core and being fastened to said housing so as to cause said core to be held firmly between said housing and said enclosure means, and wherein said core and said enclosure means are provided with through bores at which said core and said enclosure means are fitted loosely around said shaft.

* * * * *